United States Patent [19]

Deibel

[11] Patent Number: 4,822,174

[45] Date of Patent: Apr. 18, 1989

[54] BLENDING VESSEL FOR MICROBIOLOGICAL ANALYSES

[76] Inventor: Robert H. Deibel, 845 E. Johnson St., Madison, Wis. 53703

[21] Appl. No.: 169,006

[22] Filed: Mar. 16, 1988

Related U.S. Application Data

[63] Continuation-in-part of Ser. No. 937,407, Dec. 3, 1986, abandoned.

[51] Int. Cl.[4] ..... B01F 7/06

[52] U.S. Cl. ..... 366/279; 366/199

[58] Field of Search ..... 366/279, 197, 199, 206, 366/207, 241, 348, 349, 204, 314; 422/99, 50, 104; 99/348; 215/329

[56] References Cited

U.S. PATENT DOCUMENTS

| | | | |
|---|---|---|---|
| 1,123,595 | 1/1915 | Roberts | 366/99 |
| 1,877,258 | 9/1932 | Spahn | 215/329 |
| 3,175,594 | 3/1965 | Jepson et al. | 146/68 |
| 3,843,521 | 10/1974 | Zeff | 210/138 |
| 3,887,169 | 6/1975 | Maynard | 259/109 |
| 4,199,266 | 4/1980 | Giusti | 366/296 |

*Primary Examiner*—Robert W. Jenkins

*Attorney, Agent, or Firm*—Mann, McWilliams, Zummer & Sweeney

[57] ABSTRACT

A culture blending vessel adapted for the preparation and containment of samples for microbiological analysis which includes a vessel body and a rotor assembly. The mouth opening of the vessel body is closed by a lid which threads onto the top of the vessel. The rotor assembly has a rotatable shaft extending through a port in the cylindrical side wall of the vessel body. Blending knives are fastened to the interior end of the shaft and may be used to blend the contents of the container by coupling the exterior end of the shaft to a blending motor. The blended sample may then be incubated without transfer to a separate culture vessel.

10 Claims, 3 Drawing Sheets

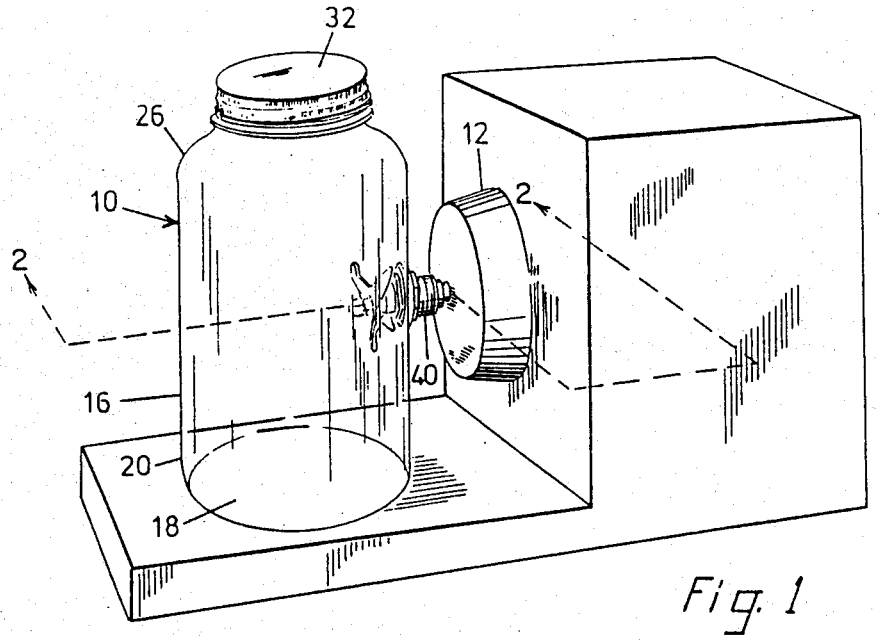
Fig. 1
Fig 2
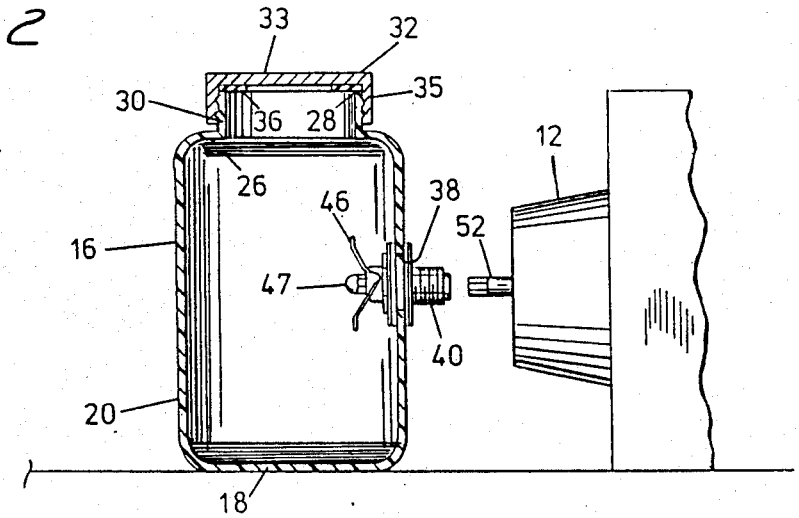

BLENDING VESSEL FOR MICROBIOLOGICAL ANALYSES

This Application is a continuatin-in-part of my Application Ser. No. 937,407, filed Dec. 3, 1986, now abandoned.

TECHNICAL FIELD

This invention relates to the field of culture vessels for use in microbiological analyses, and more particularly to culture vessels adapted for analyses requiring the initial blending and mixing of a sample to be tested with a culture medium.

BACKGROUND ART

The first step in a number of microbiological analyses is the mechanical blending of the sample to be analyzed together with the mixing of the sample with a growth medium selected to be conductive to the rapid multiplication of the particular bacteria to be detected. For example, in the Salmonella detection procedure, sample amounts of from 25 to 375 grams commonly are blended mechanically with varying amounts of growth medium.

In practice, conventional food blenders comparable to those commonly sold for kitchen use are employed to accomplish the blending and mixing. The blending vessels used with these blenders for laboratory purposes are usually stainless stell or aluminum and are quite expensive. The blending vessels conventionally have a rotor assembly fastened in the bottom of the vessel which includes a vertical shaft extending through the bottom of the vessel. The shaft is held in a fluid-tight bearing or seal such that it may be easily rotated without leakage of the contents of the vessel. A cluster of blades or some other blending member is fastened to the inner end of the shaft and extends into the interior of the blending vessel. A coupling is usually located at the opposite end of the shaft, outside of the blending vessel, to allow the shaft to be removably engaged with the motor of the blender. As is well known in this art, the rotor that actuates the blending blades is to rotate at high speeds, such as 10,000 rpm, to produce the shearing action required to homogenize the solid materials that have been introduced into the vessel, with the liquid medium within the vessel.

Conventional blending vessels are substantially square in horizontal cross section. The square shape serves to break up the central vortex that tends to result from the rotation of the blades through the material contained in the blender. If the blending vessel were round in horizontal cross section, the contents would swirl about, forming a vortex driven by the blades. Such an arrangement would increase the chance for spillage if the blades were driven above a given speed and reduce the vertical migration of vessel contents so that materials in the upper part of the vessel might never come into contact with the whirling blades.

After being blended for a suitable length of time, the sample and the growth medium are reduced to a slurry. The slurry is then placed in a culture vessel that often contains an additional quantity of growth medium. When large amounts of sample are involved, more than one blending operation may be required owing to the limited capacity of the blending vessel. Conventional culture vessels are round in horizontal cross section in order to fit conveniently into common designs of centrifuges, bottle racks, and other lab equipment.

In order to avoid contamination, the entire blending and transfer process must be done under aseptic conditions. The blending vessel, culture vessel, and growth medium all must be sterilized before the procedure is begun. Almost invariably, blending and culture vessels are made of an autoclavable material and are sterilized by autoclaving. The growth medium may be autoclaved either separately, in a storage vessel, or in the blending or culture vessel in which it is to be used. The chance of undesirable microbiological contamination increases with every additional vessel involved in the total operation and with every transfer that must be made between vessels.

After blending and subsequent transfer to the culture vessel, a sample is incubated for a selected period of time whereafter subcultures are made and the detection procedure is continued. The growth medium and sample in the culture vessel may then be disposed of. Before disposal, it is necessary to sterilize the incubated growth medium because of the possible presence of dangerous microbiological species. Similarly, the blending vessel used at the beginning of the process also must be sterilized prior to washing to prevent any spread of the bacteria that may be present in the sample. While it is possible to use a bactericidal agent to sterilize the blending vessel, culture vessels and their contents are customarily autoclaved owing in part to the difficulty of reliably mixing a bactericidal agent with what is often a fairly large amount of growth media. Unfortunately, autoclaving is an inconvenient, time and energy consuming process, and is therefore expensive compared to the use of bactericides.

DISCLOSURE OF THE INVENTION

The culture blending vessel of the present invention is well adapted for both the preparation and containment of samples for microbiological analysis. The culture blending vessel includes a container portion having a vessel body with a bottom wall, a substantially circular, vertical side wall formed integrally with and extending from the bottom wall, a neck portion which extends from the side wall to the opening in the vessel. A lid is adapted to close the opening in removable, fluid-tight relation. A rotor assembly having a rotatable shaft extends through a rotor port formed in the vessel side wall such that the shaft is substantially horizontal when the vessel bottom wall is on a horizontal surface. The shaft has an inside end and an outside end, with at least one blending member rigidly attached to the inside end, and a coupling rigidly attached to the outside end. Sealing of the rotor assembly and about the rotor port is made leakage free and thus hermetic to avoid damage to the biological integrity of the vessel contents, in use of the vessel of this invention. Several sealing arrangements are suggested in this disclosure, though it will be appreciated that those skilled in fluid sealing technology will be enabled to otherwise meet these requirements.

Preferably, the vessel body is made of a material that can withstand autoclaving such as glass and polypropylene. The use of a transparent material such as glass has the added advantage of allowing visual inspection of the contents during the various steps of an analysis. All other parts of the culture blending vessel can also withstand autoclaving, allowing the vessel to be autoclaved as a unit before being used for microbiological analysis. For example, a suitable quantity of culture medium may be introduced to the culture blending vessel before autoclaving, or, alternatively, the culture medium may be separately sterilized and then introduced into the vessel aseptically.

A sample to be analyzed is introduced into the vessel through the mouth opening, which is then closed with the lid, and the coupling of the rotor assembly is then engaged with a substantially horizontal drive shaft of a variable speed blending motor. The blending motor is so located relative to a horizontal surface that the drive shaft can be conveniently engaged with the coupling structure of the culture blending vessel when the bottom of the vessel is resting upon the surface. With the vessel set in place, the blending motor is activated, and the sample is both blended and mixed throughout the culture medium. Because of the side location of the rotor assembly, no undisturbed vortex is generated in the vessel's contents, and satisfactory blending can be achieved without resort to a square horizontal bottle cross section. Therefore, the culture blending vessel may be made in a cylindrical shape suitable for use in common centrifuges, racks, and other laboratory equipment.

It will be appreciated that, since the culture blending vessel is directly used as the culture vessel for subsequent incubation, considerable time is saved not only by eliminating the need for an aseptic transfer to a separate culture vessel, but also by eliminating the washing and sterilization steps necessary to prepare the separate culture vessel. Furthermore, the danger of introducing contamination at the time of transfer to a separate culture vessel is entirely eliminated. Finally, when it is desired to dispose of the potentially dangerous contents of the culture blending vessel, it is possible to add a bactericide and thoroughly mix it with the contents of the vessel by use of the rotor assembly. Thus, safe disposal of samples may be accomplished without the time, labor, and energy consuming autoclave sterilization traditionally used.

Further objects, features, and advantages of the invention will be apparent from the following detailed description taken in conjunction with the accompanying drawings.

BRIEF DESCRIPTION OF THE DRAWINGS

In the drawings:

FIG. 1 is a perspective view of the culture blending vessel of the invention engaged with a vertically mounted blending motor;

FIG. 2 is a cross-sectional view of the vessel of FIG. 1 taken along the section line 2—2 of FIG. 1, with the vessel shown spaced away from the blender motor;

In the showings of FIGS. 4 and 5, similar reference numerals are employed to indicate similar parts.

SPECIFIC DESCRIPTION

Figure 3:
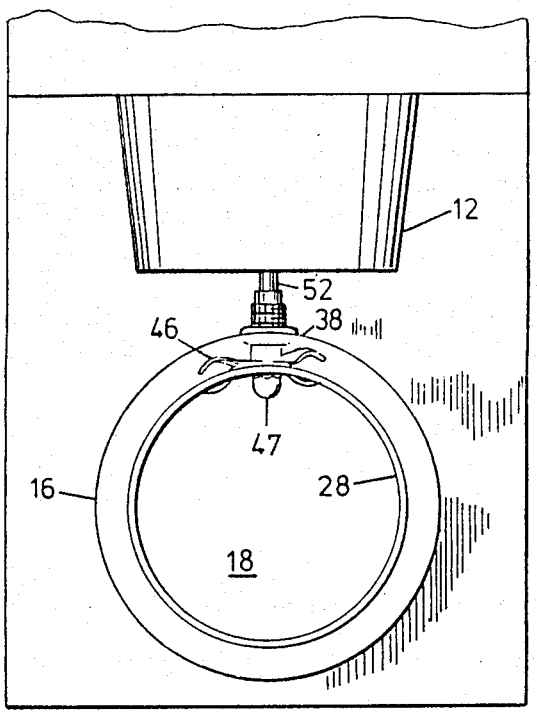
FIG. 3 is a top plan view of the vessel of FIG. 1 with the cover removed.

Referring more particular to the drawings, wherein like numbers refer to like parts, FIGS. 1–3 illustrate a novel culture blending vessel, shown generally at 10, coupled with a conventional blender motor shown at 12. As is conventional, motor 12 revolves at approximately ten thousand revolutions per minute, and it is controlled in the usual manner by a suitable rheostate.

The culture blending vessel 10 has a vessel body 16 preferably molded of an autoclavable material, and preferably transparent or translucent. Polypropylene and glass are examples of preferred materials. The vessel body 16 has a bottom wall 18 that is substantially flat and round. A substantially cylindrical vertical side wall 20 is formed integrally with and extends upwardly from the bottom wall 18. A neck 26 extends axially upward from the side wall 20, is formed integrally therewith, and converges inwardly toward the opening of the vessel. The neck 26 terminates in an edge 28 which defines the open mouth of the vessel. Threads 30 are formed on the outside surface of the neck 26, and a lid 32 is secured to the top of the vessel by the threads.

The lid 32 preferably has a substantially disc shaped lid back 33 and an annular lid collar 35 which extends axially from the peripheral of the lid back and has internal threads which are adapted to engage the neck threads 30. By firmly screwing the lid down on the vessel body, a user may effectively close the vessel opening by causing the inside surface of the lid back to be pressed against the edge of the vessel neck.

If the lid 32 or the vessel body 16 is made of a material that may be slightly compressed resiliently, screwing the lid down firmly on the neck edge 28 will be sufficient to accomplish a fluid-tight closure. Alternatively, a resilient lid gasket 36 may be located on the inside surface of the lid back 33 and be adapted to engage the neck edge 28 in fluid-tight relation when the lid is threadedly engaged with the vessel body.

Figure 4:
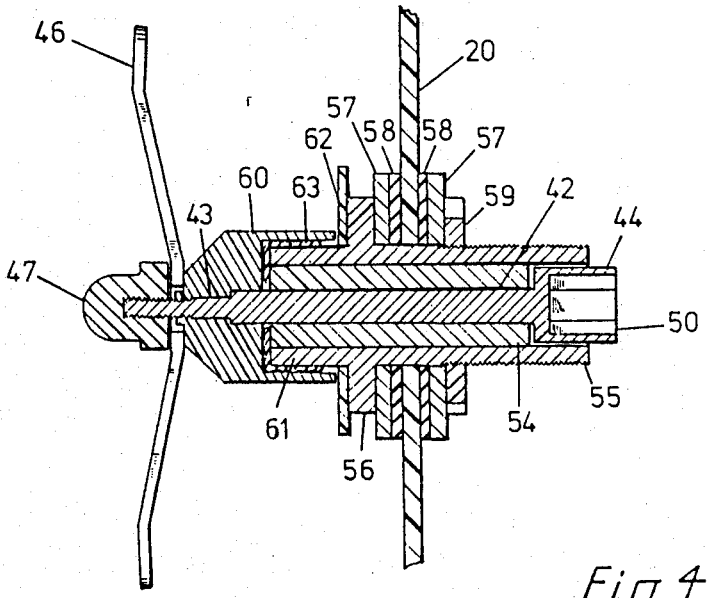
FIG. 4 is a detail cross-sectional view of the rotor assembly and contiguous parts of the vessel side wall; and, FIG. 5 is a view similar to that of FIG. 4, but illustrating a modification.

A rotor port 38 is formed in the vessel vertical side wall 20. Port 38 may be located about midway between the top and the bottom of the vessel, as shown. A rotor assembly 40 mounted in the rotor port 38 has a substantially horizontal rotor shaft 42 that extends through the rotor port in rotatable relation thereto, as best shown in FIG. 4. The rotor shaft has an inside end 43, located within the space contained by the vessel body 16, and an outside end 44, projecting to the outside and beyond the side wall 20. Curved blender blades 46 are attached to the inside end 43 of the shaft by a nut 47. As the rotor shaft 42 rotates, the blades 46 describe an arc within the space contained by the vessel body 16. A coupling 50 is formed on the outside end 44 of the rotor shaft and has an articulated socket formed therein which is adapted to engage the drive shaft 52 of the conventional blender motor 12. Alternately, port 38 may be located elsewhere along the height of the vessel side wall 20, though, of course, the port 38 is to operably mount the rotor assembly 40 vertically along the vessel side wall 20 so as to achieve the blending function contemplated by the invention.

One detailed structural arrangement of the rotor assembly 40 for leakage free purposes is shown in the cross-sectional view of FIG. 4. The shaft 42 (which may be formed from brass coated with steel) rotates in a brass bushing 54 which fits within a rotor body or housing 55 that is formed from, for instance, sintered bronze. The rotor body or housing 55 includes a flange 56 formed about its periphery which allows the rotor assembly 40 to be mounted in fluid-tight engagement with the vessel side wall 20 with the aid of washers 57, gaskets 58, and a nut 59 which threads over the exterior end of the rotor body 55. A cap 60 is mounted on the interior end 43 of the shaft 42 to rotate therewith, and has a laterally extending, annular skirt portion which covers the interior end 61 of the rotor body 55. The rotor assembly 40 is made fluid tight by the insertion of a thin Teflon (polytetrafluoro-ethylene) plate 62 between the flange 56 and the bottom edge of the skirt on the cap 60. The bottom edge of the cap 60 thus rotates at or near contact with the Teflon plate 62. Additional sealing integrity is achieved by covering the interior end 61 of the rotor body with a polymerizable elastomer sealer 63, such as General Electric Hi-Temp silicone, to substantially fill the space between the inside of the cap 60 and the interior end of the rotor body 55 without unduly interfering with the rotation of the cap. The sealing material used preferably is capable of withstanding high temperatures, e.g., up to 600 degrees F., since the culture blending vessel 10 may be sterilized by autoclaving. The combination of the Teflon plate 62 with the elastomer sealing material 63 over the inner end of the rotor body provides a very tight seal about the rotor shaft which prevents leakage of material from the vessel, or contamination of the contents of the vessel from external microorganisms. The integrity of sealing of the rotor assembly 40 is much more critical than the integrity of sealing required for conventional uses of blending vessels because any leakage into or out of the vessel could ruin the biological integrity of the contents.

Figure 5:
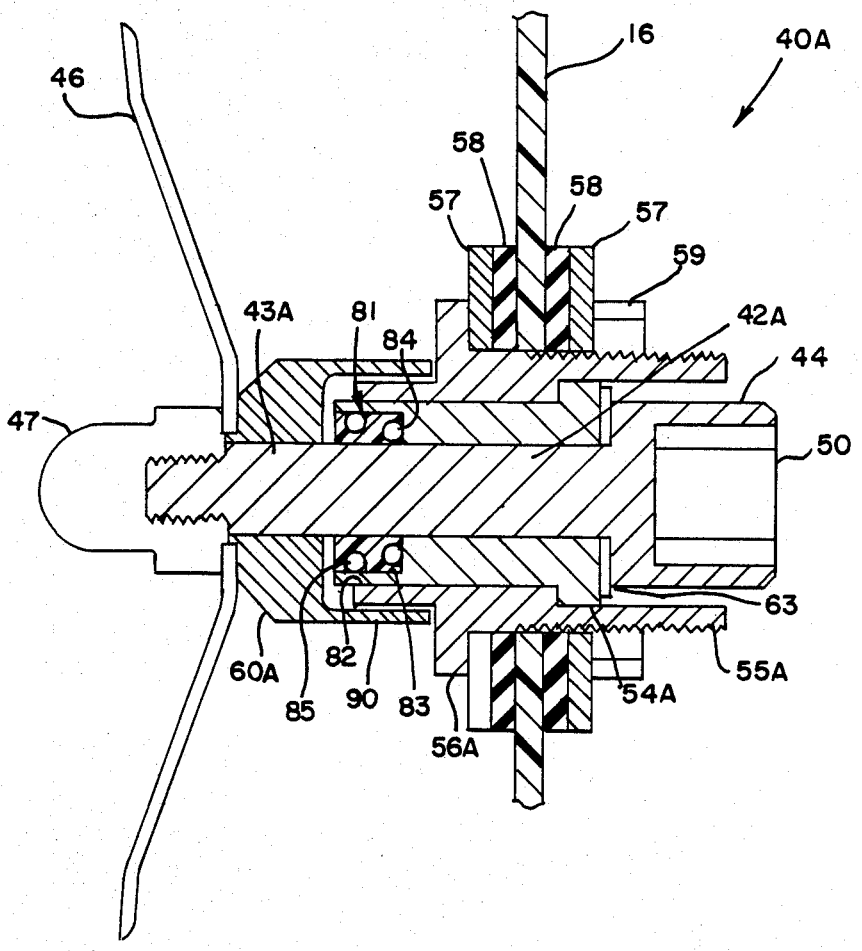

Another detailed arrangement of the rotor assembly 40, for achieving leakage free purposes, is shown at 40A in the cross-sectional view of FIG. 5, this showing representing what is now believed to be the best mode of effecting sealing at port 38. In this embodiment, the rotor shaft 42A rotates in brass bushing 54A which fits within rotor body or housing 55A (that also may be formed from sintered bronze) 55. The rotor body or housing 55A includes flange 56A formed about its periphery which allows the rotor assembly 40A to be mounted in fluid-tight engagement with the vessel side wall 16 with the aid of washers 57, gaskets 58, and nut 59 which threads over the exterior end of the rotor body 55A (as in embodiment of FIG. 4). Cap 60A is mounted on the interior end 43A of the shaft 42A to rotate therewith, and has the laterally extending, annular skirt portion 90A which overlaps the rotor body or housing 55A, and in close fitting sealing relation thereto.

The busing 54A of FIG. 5 contains a countered-bored well 82 which receives a conventional lip-type, spring-loaded, Bal seal 81, such that leakage between the bushing 54A and drive shaft 42A is precluded (seal 81 is commercially available from Bal Seal Engineering Co., Inc. of Santa Ana, Calif. The seal 81 contains a body 83 that is formed of poly-teflon-fluro-ethylene or equivalent materials that allow for minimal friction and heat buildup during operation. The seal body 83 mounts two toroidal springs 84 and 85; with spring 84 exerting radially outwardly acting pressure on the body 83 to create a fluid sealing action with respect to bushing 54A, while spring 85 exerts a radially inwardly acting pressure on body 83 around rotor shaft 42A to create a fluid sealing action about shaft 42A. The springs 84 and 85 are made of stainless steel and work together on body 83 to create a fluid leakage resistant annular barrier within shaft housing 55A.

The entire seal 81 withstands repeated sterilization temperatures of 250 Degrees F. The seal 81 enables rotor assembly 40A to preclude leakage of the culture during incubation and and seal 81 also maintains microbiological integrity by averting contamination from the outside environment.

In practice, the vessel body 16 is filled with a desired amount of culture medium. The lid 32 is threadedly engaged with the threaded portion 30 of the vessel body 16 but is not tightened, allowing for an exchange of gases between the interior and exterior of the vessel body. The filled vessel is then autoclaved. When the vessel and the culture medium have cooled sufficiently, the lid 32 is tightened to prevent culture medium spillage or contamination, and the culture blending vessel is stored until desired for use. Alternatively, the culture medium may be autoclaved separately and transferred aseptically to the vessel.

When it is desired to make use of the filled and sterilized culture blending vessel for conducting a microbiological analysis, the lid 32 is removed, the sample is inserted through the mouth of the vessel, and the lid is replaced with enough force to insure a fluid-tight seal. The coupler 50 of the rotor assembly 40 is then engaged with the drive shaft 52, and the rotor assembly is rotated at the desired speed causing the sample to be blended by the whirling blades 45. Because of the side location of the rotor assembly, no undisturbed vortex is generated and satisfactory blending can be achieved without resort to a square horizontal vessel cross-section. It may be noted that blending may also take place with the vessel on its side if the vessel is supported at the proper height to allow the drive shaft 52 to engage the coupler 50.

When sufficient blending has occurred, the vessel 10 is disengaged from the blender motor 12 and held at the temperature desired for culturing the microorganism(s) the user is seeking to detect. There is no need to transfer the blended sample and culture medium to a second vessel for culturing. When it is desired to dispose of the incubated sample, a batericide may be added and thoroughly mixed throughout the incubated sample by means of a second blending. After the passage of time sufficient for the bactericide to kill any harmful bacteria in the cultured sample, the blending culture vessel may be emptied and washed without the need for a prior autoclaving. The vessel may then be filled with a new quantity of growth medium, autoclaved, and stored until desired for use in a subsequent analysis.

It is understood that the invention is not confined to the particular construction, arrangement of parts, and materials herein described and illustrated, but embraces such modified forms thereof as come within the scope of the following claims.

What is claimed is:

1. A culture blending vessel for use with a blender motor having a substantially horizontal drive shaft, and adapted for preparing and containing samples, and also the culturing of same, for microbiological analysis comprising:

a vessel body formed of an autoclavable material having an essentially flat bottom wall, a substantially cylindrical, vertical side wall formed integrally with said bottom wall and extending upwardly therefrom, a mouth opening at the top of said side wall through which material can be deposited in and removed from said body, and a rotor port formed in said side wall a selected distance above said bottom wall;

a lid closing said mouth opening in selectively removable, fluid-tight relation; and a rotor assembly mounted in said rotor port and having a substantially horizontal rotor shaft mounted for rotation and extending from the outside to the inside of said vessel body, blending blades attached to the inside end of said rotor shaft for rotation therewith, a coupling on the outside end of said rotor shaft which is adapted to removably and drivingly engage the drive shaft of a blending motor, and means for effecting a fluid tight seal about said rotor shaft for making said vessel fluid-tight at said rotor port.

2. The culture blending vessel specified in claim 1 wherein the vessel body is formed of glass.

3. The culture blending vessel specified in claim 1 wherein the vessel body is formed of polypropylene.

4. The culture blending vessel specified in claim 1 including:

a substantially tubular neck extending axially from said side wall and converging inwardly for a selected distance and having an inside surface, an outside surface, a top edge located at the furthest extension of said neck to define said mouth opening, and threads located on said outside surface of said neck, and wherein:

said lid has a substantially disc-shaped lid back selected to be large enough to close said mouth opening and surface, and including an annular lid collar depending axially from the periphery of said lid back and having threads formed on the inside surface of said collar, which threads are adapted to threadedly engage said neck threads, whereby said lid may be engaged with the vessel body in such manner that said edge of said neck is pressed against said inside surface of said lid back in fluid-tight relation.

5. The culture blending vessel specified in claim 4 wherein a resilient lid gasket is located on said inside surface of said lid back and is adapted to engage said edge of said neck in fluid-tight relation when said lid is threadedly engaged with the vessel body.

6. The culture blending vessel specified in claim 1 wherein each of said blending blades comprises a curved blade extending radially from the inside end of said shaft for a selected distance, with such blade being adapted to sweep through a selected part of the area contained within the vessel body when said shaft is rotated.

7. The bleeding culture vessel specified in claim 1 wherein said rotor assembly further comprises a rotor body extending through said rotor port in said vessel in side wall, a bushing within said rotor body through which said rotor shaft is mounted for rotation, a cap attached to said rotor shaft within said vessel and having a skirt which covers and rotates around the end of the rotor body within the vessel, a plate formed of polytetrafluoroethylene mounted around said rotor body with the bottom edge of the cap in sliding engagement therewith, and silicone elastomer covering said inner end of said rotor body under said cap to substantially fill the space between said cap and said inner end of said rotor body without unduly interfering with the rotation of said cap.

8. The blending culture vessel specified in claim 1 wherein said rotor assembly further comprises a rotor body extending through said rotor port in said vessel side wall, a bushing within said rotor body through which said rotor shaft is mounted for rotation, a cap attached to said rotor shaft within said vessel and having a skirt which covers and rotates around the end of the rotor body within the vessel, and a lip-type, spring-loaded Bal seal mounted in a counter-bored well formed in said bushing to preclude leakage between the drive shaft and said bushing.

9. A culture blending vessel for use with a blender motor having a substantially horizontal drive shaft, and adapted for preparing and containing samples for microbiological analysis, comprising:

a vessel body formed of an autoclavable material having a bottom wall, a substantially cylindrical, vertical side wall formed integrally with the bottom wall and extending upwardly therefrom, a mouth opening at the top of the side wall through which material can be deposited in and removed from the container, and a rotor port formed in the side wall a selected distance above the bottom wall;

a lid closing the mouth opening in selectively removable, fluid-tight relation; and a rotor assembly mounted in the rotor port and having a substantially horizontal rotor shaft mounted for rotation and extending from the outside to the inside of the vessel body, blending blades attached to the inside end of the rotor shaft for rotation therewith, a coupling on the outside end of the rotor shaft which is adapted to removably engage the drive shaft of a blending motor, and a fluid-tight shaft seal engaging the rotor shaft in fluid-tight, sliding relation, said rotor assembly further comprising a rotor body extending through the rotor port in the vessel side wall, a bushing within the rotor body through which the rotor shaft is mounted for rotation, a cap attached to the rotor shaft within the vessel and having a skirt which covers and rotates around the end of the rotor body within the vessel, a plate formed of polytetrafluorethylene mounted around the rotor body with the bottom edge of the cap in sliding engagement therewith, and silicone elastomer covering the inner end of the rotor body under the cap to substantially fill the space between the cap and the inner end of the rotor body without unduly interfering with the rotation of the cap.

10. A culture blending vessel for use with a blender motor having a substantially horizontal drive shaft, and adapted for preparing and containing samples for microbiological analysis, comprising:

a vessel body formed of an autoclavable material having a bottom wall, a substantially cylindrical, vertical side wall formed integrally with the bottom wall and extending upwardly therefrom, a mouth opening at the top of the side wall through which material can be deposited in and removed from the container, and a rotor port formed in the side wall a selected distance above the bottom wall, a lid closing the mouth opening in selectively removable, fluid-tight relation; and a rotor assembly mounted in the rotor port and having a substantially horizontal rotor shaft mounted for rotation and extending from the outside to the inside of the vessel body, blending blades attached to the inside end of the rotor shaft for rotation therewith, a coupling on the outside end of the rotor shaft of a blending motor, and a fluid-tight shaft seal engaging the rotor shaft in fluid-tight, sliding relation, said rotor assemlby further comprising a rotor body extending through the rotor port in the vessel side wall, a bushing within the rotor body through which the rotor shaft is mounted for rotation, a cap attached to the rotor shaft within the vessel and having a skirt which covers and rotates around the end of the rotor body, and a lip-type, spring-loaded Bal seal mounted in a counter-bored wall formed in said bushing to preclude leakage between the drive shaft and said bushing.

* * * * *